US007669255B2

(12) United States Patent
Raney

(10) Patent No.: US 7,669,255 B2
(45) Date of Patent: Mar. 2, 2010

(54) STORABLE DUAL ACTION HYDRAULIC LIFTING DEVICE

(76) Inventor: Terry Raney, 14266 E. Valley Blvd., City of Industry, CA (US) 91746

( * ) Notice: Subject to any disclaimer, the term of this patent is extended or adjusted under 35 U.S.C. 154(b) by 0 days.

(21) Appl. No.: 12/358,020

(22) Filed: Jan. 22, 2009

(65) Prior Publication Data

US 2009/0188038 A1 Jul. 30, 2009

Related U.S. Application Data

(60) Provisional application No. 61/062,649, filed on Jan. 28, 2008.

(51) Int. Cl.
*A61G 7/14* (2006.01)
*A61G 7/10* (2006.01)

(52) U.S. Cl. ..... 5/86.1; 5/87.1

(58) Field of Classification Search ..... 5/86.1, 5/87.1, 81.1 R; 254/8 B; 212/294, 901
See application file for complete search history.

(56) References Cited

U.S. PATENT DOCUMENTS 2,675,209 A * 4/1954 Freed ..... 254/2 R
4,420,052 A * 12/1983 Hale ..... 177/132
5,076,448 A 12/1991 Ballard
5,082,127 A 1/1992 Huang
5,117,516 A 6/1992 Penner
5,261,640 A 11/1993 Yuan
5,459,891 A 10/1995 Reeve et al.
5,560,054 A 10/1996 Simon
6,026,523 A 2/2000 Simon et al.
6,164,625 A 12/2000 Shockley et al.
6,260,218 B1 7/2001 Tsuga
6,289,534 B1 9/2001 Hakamiun et al.
6,694,545 B1 2/2004 Renton
6,857,144 B1 2/2005 Huang
7,207,612 B2 * 4/2007 Raney ..... 294/110.1
7,225,482 B2 6/2007 Brooks
7,428,759 B2 9/2008 Bain et al.

* cited by examiner

*Primary Examiner*—Alexander Grosz
(74) *Attorney, Agent, or Firm*—Edwin Tarver; Lauson & Tarver LLP

(57) ABSTRACT

A storable dual action hydraulic device has a base unit from which floor supports extend, and a series of arms that articulate relative to the base unit to lift and re-orient a lifting device. The base unit houses an on-board power supply and control systems for hydraulic cylinders. A first arm and associated hydraulic cylinder extend from the base, and a second arm and associated hydraulic cylinder extend from the extreme end of the first arm opposite the base unit. At the extreme end of the second arm opposite the first arm, a mechanism is disposed for connecting to a lifting device capable of lifting subjects such as immobile persons. The device is equipped with weight measuring equipment, a retractable handle for maneuvering the device, a hinge member from which the lifting device motorized control for the lifting device and a controller for articulating the arms of the device.

8 Claims, 5 Drawing Sheets

STORABLE DUAL ACTION HYDRAULIC LIFTING DEVICE

CROSS-REFERENCE TO RELATED APPLICATION

This application claims the benefit of the priority date of provisional application No. 61/062,649, filed on Jan. 28, 2008.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

Apparatus for lifting and transporting are known in the art, as are portable lifting apparatus for lifting invalids or other immobile persons. Hydraulic cranes are also known in the art, as are portable hydraulic cranes.

U.S. Pat. No. 7,428,759 to Bain et al. discloses a portable patient lift with spreadable support legs and a feature than enables the legs of the lift to operate in a first range of motion during operation and a second range of motion for compact folding.

U.S. Pat. No. 7,360,262 to Mowery discloses a portable lifting apparatus for lifting and transferring heavy objects. The lifting apparatus has a load-supporting platform which can be moved both vertically and rotated about the vertical axis of an upwardly extending lifting column. The apparatus further includes a retractable pulley.

U.S. Pat. No. 7,225,482 to Brooks discloses a hoist pivotally connecting a mast to a lifting arm by a mechanism comprising a link pivoting about a fixed point on the mast and a moving pivot on the lifting arm.

U.S. Pat. No. 6,694,545 to Renton discloses a lifting apparatus with variable and independently selectable height and reach. The lifting structure comprises two upwardly extendible support structures and an arm connected to the support structures.

U.S. Pat. No. 6,289,534 to Hakamium et al. discloses an assembly for lifting, supporting and transporting a person including a lifting arm pivotally coupled to an upper end of a frame, an actuator coupled to the lifting arm for moving the lifting arm between a lowered position and a raised position.

U.S. Pat. No. 5,560,054 to Simon discloses a portable lifting apparatus for lifting and transferring of patients for use in combination with a sling or other support. The apparatus is placed into an operating position by extending the support legs and lifting a boom.

U.S. Pat. No. 5,117,516 to Penner discloses a means for lifting handicapped persons from a sitting position comprising an open torso support pivotally attached to a lifting means such as a hydraulically constructed "cherry picker" lift or overhead lifting device.

U.S. Pat. No. 5,459,891 to Reeve et al. discloses an invalid lift and transport apparatus comprising a movable mast powered by a hydraulic pump. The mast has an upright mast rotatable about a vertical axis and a hydraulically extensible boom for supporting an invalid.

U.S. Pat. No. 5,261,640 to Yuan discloses a portable engine hoist that folds into a compact stowage position comprising a base, two elongated feet extending from the base, and carry wheels on their outboard ends. An upright post extends from the base and carries a pivotal lifting beam at its top end.

U.S. Pat. No. 5,076,448 to Ballard discloses a hydraulic crane comprising a generally trapezoidal frame with a caster wheel at each corner. A mast mounted on the front of the arm with a brace between each rear corner and top of the mast is connected with spring loaded pins.

SUMMARY

A storable device for lifting and transporting immobilized persons or objects comprises a base unit which serves as the body of the device, two floor supports extending from the base unit, a first arm connected to the base unit and a second arm connected to the first arm.

The first arm connects to the base in a manner permitting it to articulate relative to the base in one plane. Movement is achieved by a first hydraulic cylinder connected between the first arm and the base unit. A handle attached to the device adjacent the first hydraulic cylinder allows a user to steer the device.

A second arm connected to the first arm articulates relative to the first arm via a second hydraulic cylinder connected between the first arm and second arm. Power and control for the first hydraulic cylinder and second hydraulic cylinder is contained in the base unit, and a controller is associated with the base unit for controlling the device. An onboard rechargeable battery allows the device to operate independent of an electrical source.

A lifting support connected to the second arm opposite the first arm is hinged and allows the lifting support to depend from the second arm regardless of the second arm's position. The lifting support can lock in a position relative to the device to prevent a payload from swinging while in motion, and also comprises a weighing scale. The lifting support interfaces with a hinge jawed mechanism similar to the mechanism disclosed in U.S. Pat. No. 7,207,612, wherein the lifting support has a motor to cause the jaws to open and close prior to lifting an object.

The base is disposed on swivel casters. The floor supports have one part parallel to the floor on smaller casters and another part disposed at an angle connecting to the base. The casters under the base and under the ends of the support members opposite the base are swivel casters, while the casters under the support members at the mid-point of the base and floor supports are rigid casters functioning as an axis about which the device can turn while remaining in position. In one embodiment the support members are constructed so the rigid casters extend down farther than the swivel casters allowing the device to cantilever over the rigid casters.

At the extreme end of the second arm of the device, a variety of additional devices are disposed for integrating a lifting mechanism. The end the second arm comprises a hinge mechanism. The hinge mechanism enables the payload of the device to swing when the device is in motion. The hinge mechanism is oriented to the device so that it only swings in the plane of movement of the arms of the device. A locking mechanism associated with the hinge mechanism can lock the mechanism in position if necessary, and a scale is provided for weighing the device's payload.

The device is initially removed from storage in a folded, compact configuration wherein the first and second arms are folded together adjacent the support members. The articulating handle is used to guide the device to a location for use. To unfold the device, the controller causes the first hydraulic cylinder to retract, lifting the first arm toward a vertical position, and causes second hydraulic cylinder to extend causing the second arm to unfold from the first arm.

As the second arm unfolds, the lifting device attached to the hinge depends downward. For lifting immobile persons in a hospital or other similar setting, the device is maneuvered so that the support members extend under a bed and the lifting device disposed above the subject to be moved. The controller lowers one or both of the arms, thereby lowering the lifting device over the subject. The controller then causes the lifting device to capture the subject and rise off the bed or other surface by the action of the hydraulic cylinders.

Once the subject is lifted, the first and second members of the device can be articulated to move toward or away from the base unit. The hydraulics are calibrated so that a patient can be moved horizontally without changing vertical elevation, in the manner of a level luffing crane. The device can also be swiveled to move the position of the device and payload by virtue of the casters and pulled in any direction or rotated on axis using the handle.

The connection between the support means and lifting device, permits the lifting device to spin on a vertical axis under the hinge, while allowing the lifting device to swing along the orientation of the first and second arms. This permits the lifting device to maintain a downward position as the first and second arms articulate. Once the subject is in a lifted position, to prevent the lifting device from swinging, a locking mechanism incorporated into the hinge locks the hinge in place. To lower the subject, the locking mechanism is disengaged if necessary, and the first and second arms to lower the lifting device to a desired surface. When the subject comes to rest on the surface, the controller causes the lifting device to disengage from the subject. The first and second arms then lift the lifting device away from the subject.

DESCRIPTION

Figure 1:
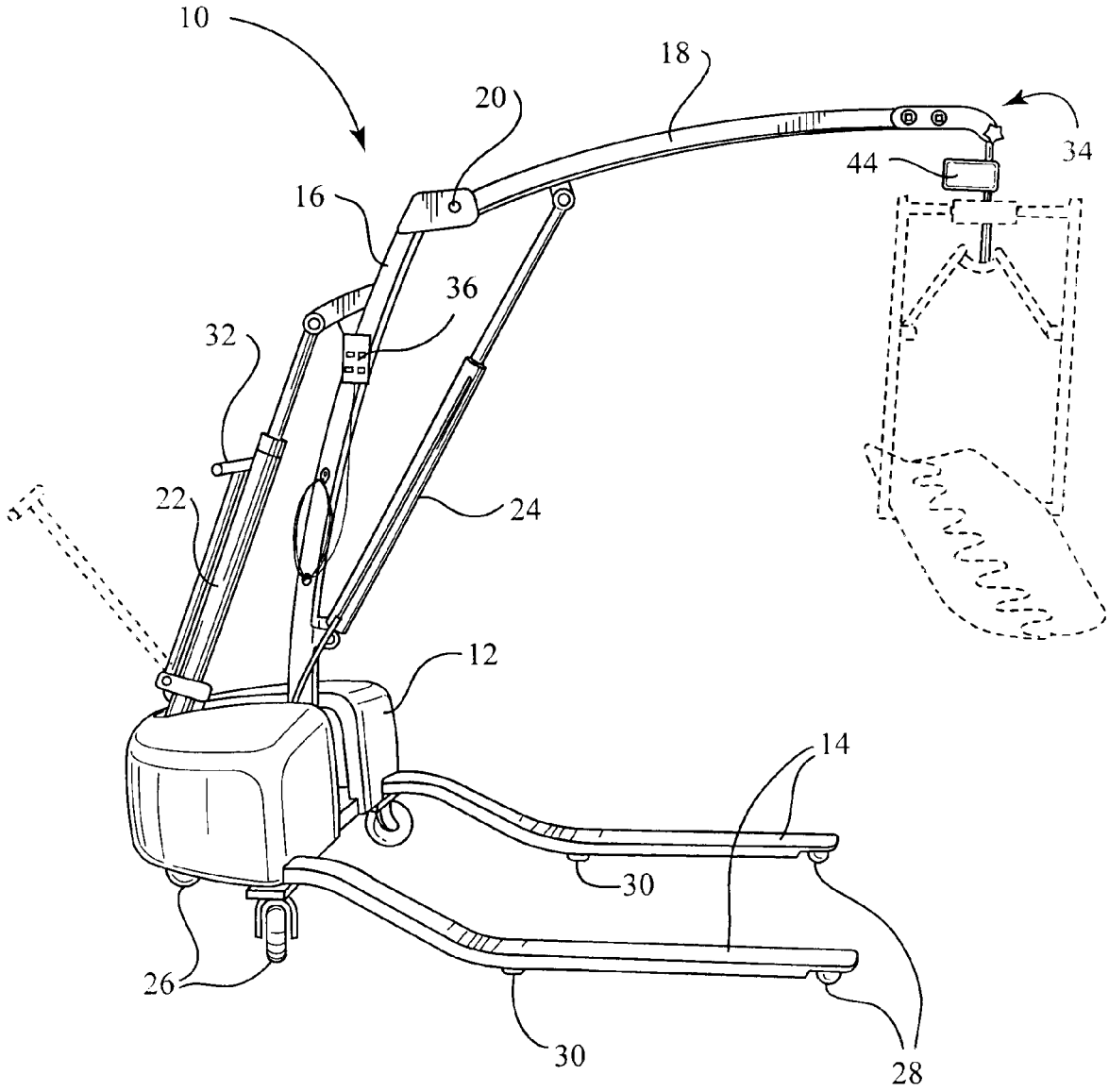
FIG. 1 is a side view of the device of the present invention with the support members in a raised position.

Referring to FIG. 1, a storable device for lifting and transporting subjects, including immobilized persons is shown and described. The device 10 comprises a base unit 12 which serves as the body of the device 10 and houses its power and control source. Two floor supports 14 are connected to and extend away from the base unit 12. In one preferred embodiment, the base member 12 comprises large casters 26 and the support members 14 comprise smaller casters 28, 30. In a further preferred embodiment, the set of small casters 30 disposed at the midpoint of the support members 14 and base 12 comprise rigid casters and the small casters 28 disposed at the extreme end of the support members 14 opposite the base unit 12 comprise swivel casters. In this embodiment, the base unit 12 also comprises swivel casters, thereby permitting the device to turn on an axis defined by the rigid casters 30. In another embodiment, the bottoms of the rigid casters 30 are lower than the swivel casters 26, 28, allowing the device 10 to cantilever over the rigid casters 30. The portion of the floor supports 14 between the rigid casters 30 and base 12 is disposed at an angle.

Still referring to FIG. 1, a first arm 16 is connected to the base unit 12 in a manner that permits the first arm 16 to articulate relative to the base unit 12 in a two dimensional plane. The first arm 16 articulates relative to the base unit 12 by means of a first hydraulic cylinder 22 connected between the first arm 16 and a position on the base unit 12 opposite the floor supports 14. In one preferred embodiment, an articulating handle 32 is attached to the device 10 adjacent the first hydraulic cylinder 22. In another preferred embodiment, battery power and hydraulic power control for the hydraulic cylinders 22, 24 is contained in the base unit 12.

Still referring to FIG. 1, a second arm 18 is connected to the first arm 16 by a hinge 20 in a manner that permits the second arm 18 to articulate relative to the first arm 16. A second hydraulic cylinder 24 is connected between the second arm 18 and first arm 16. In a preferred embodiment, power and control for the second hydraulic cylinder 24 is contained in the base unit 12. In yet another embodiment, a controller 36 is associated with the base unit 12 for controlling the device 10.

Still referring to FIG. 1, a hinged support 34 is connected to the end of the second arm 18 opposite the first arm 16. The hinged support 34 connects to the second arm 18 in a hinged manner that permits the hinged support to depend from the second arm 18 regardless of the second arm's angle. In one preferred embodiment, the hinged support 34 can be locked in position to prevent a subject carried by the device 10 from swinging while in motion. In another preferred embodiment, the hinged support 34 comprises a scale (not shown) for weighing a person or object supported by the device 10. In yet another preferred embodiment, the hinged support 34 interfaces using a motor 44 with a hinge jawed mechanism similar to the mechanism disclosed in U.S. Pat. No. 7,207,612, causing the jaws to open prior to lifting a person.

Figure 2:
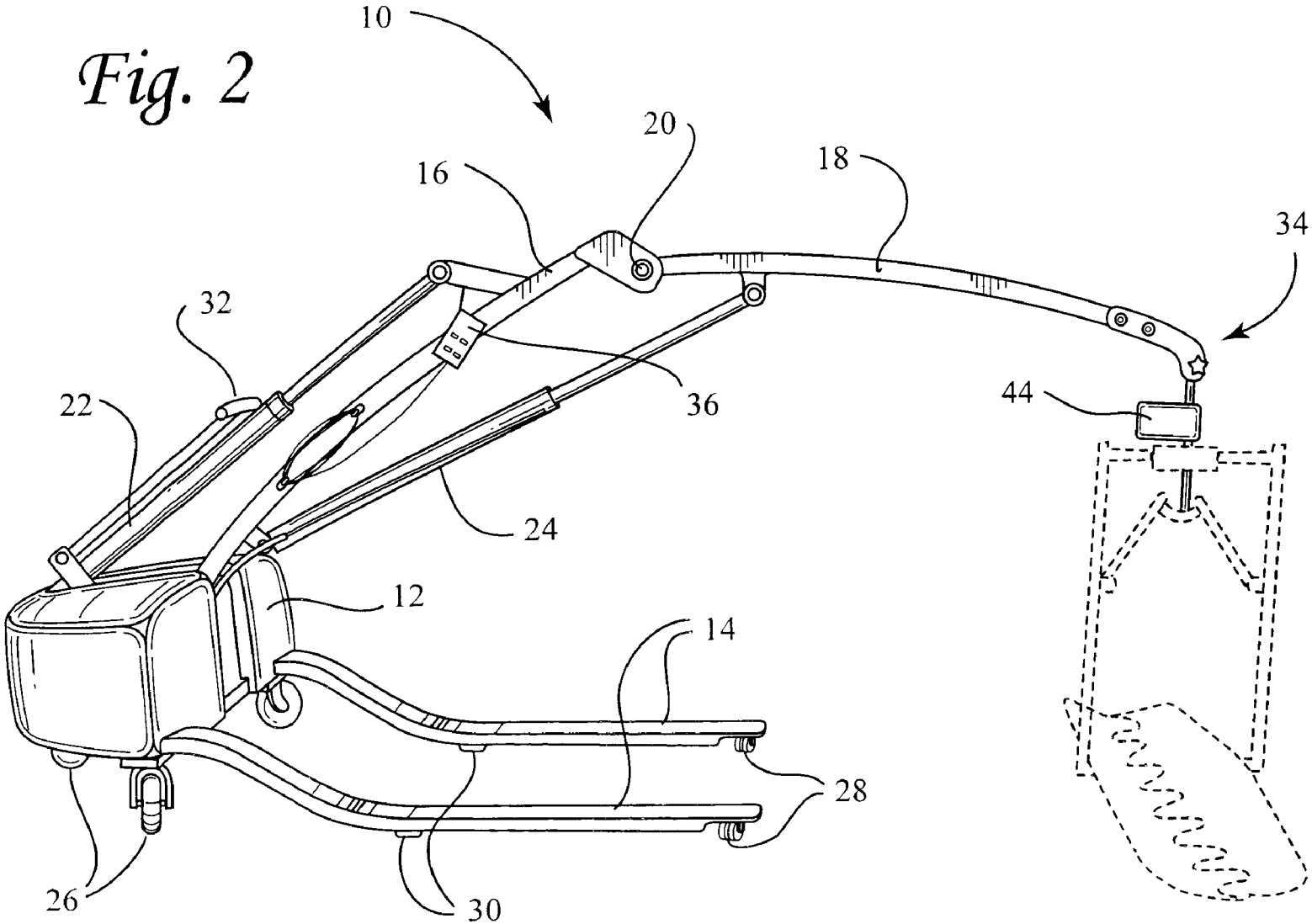
FIG. 2 is a side view of the device of the present invention with the support members in an extended position and a lifting device attached to the end of the second arm.
Figure 3:
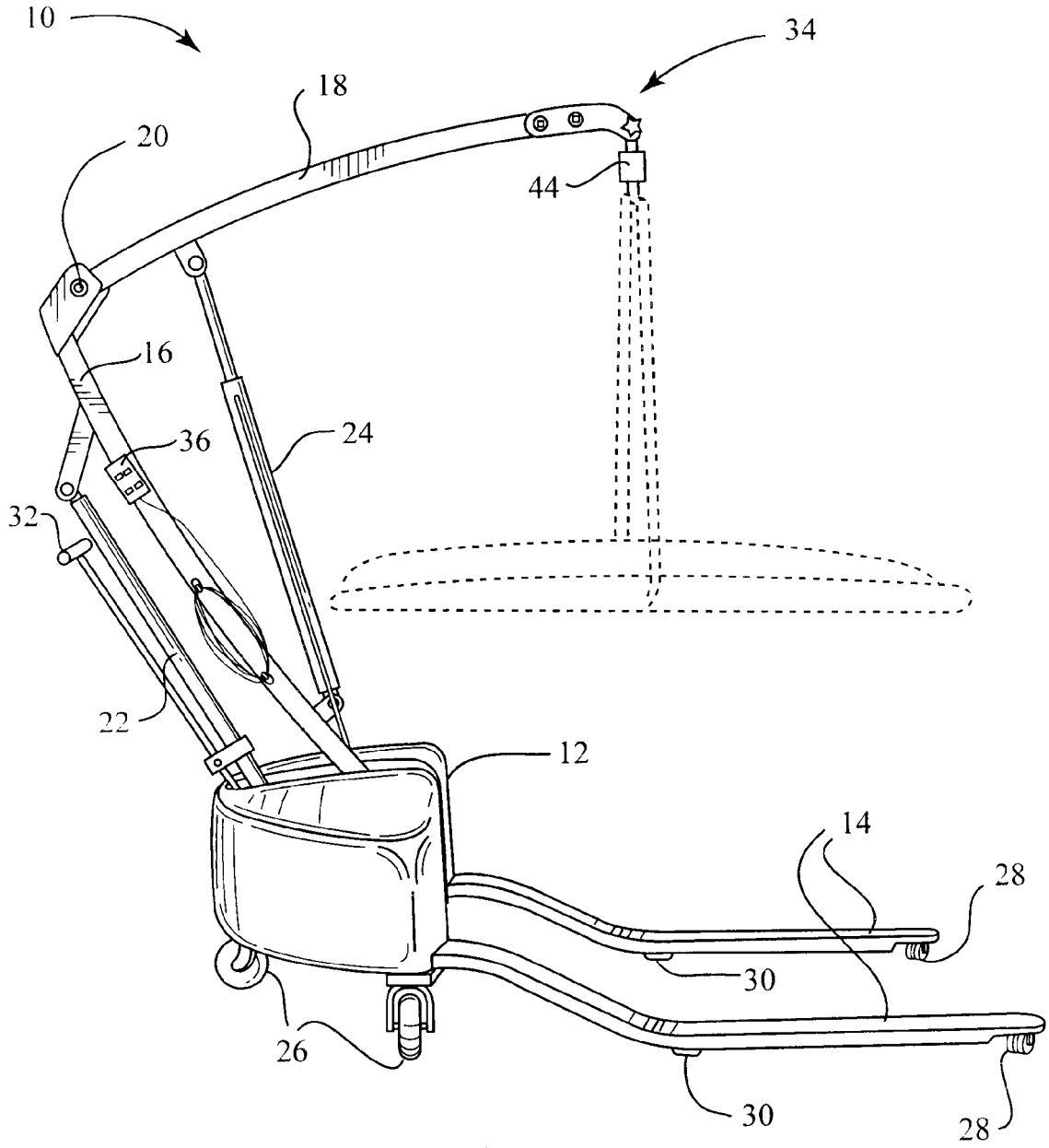
FIG. 3 is a side view of the device of the present invention with the support members in a raised and retracted position ready for transport and a lifting device attached to the end of the second arm.

FIG. 2 shows the device with the hinged support extended for lifting a payload at a distance from the device, including lifting a person from a position on the ground. FIG. 3 shows the device with hinged support in a raised and retracted position to stabilize the device's center of gravity prior to moving a subject.

Figure 4:
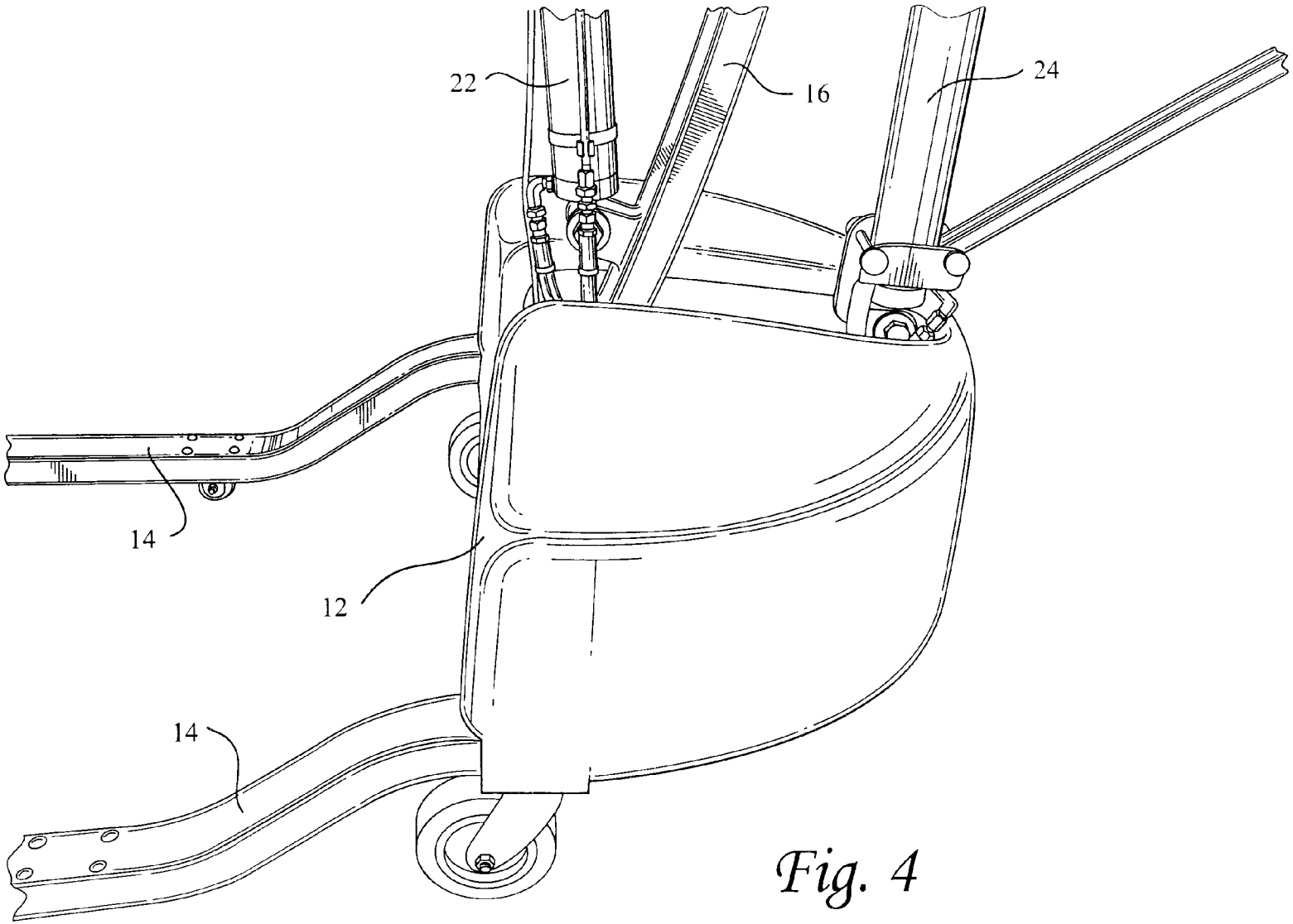
FIG. 4 is a perspective view of the base of the present invention showing details of the base mechanism.

Referring to FIG. 4, a close up of the base is shown demonstrating the elevated position of the base 12 relative to the sloping floor supports and the large casters 26 supporting the base. Additionally the hydraulic cylinder connections of the device can be seen, including the second hydraulic cylinder 24 for moving the second arm (not shown) and the first hydraulic cylinder 22 for moving the first arm 16. The handle 32 is also shown in an unfolded position wherein a user can move and steer the device.

Figure 5:
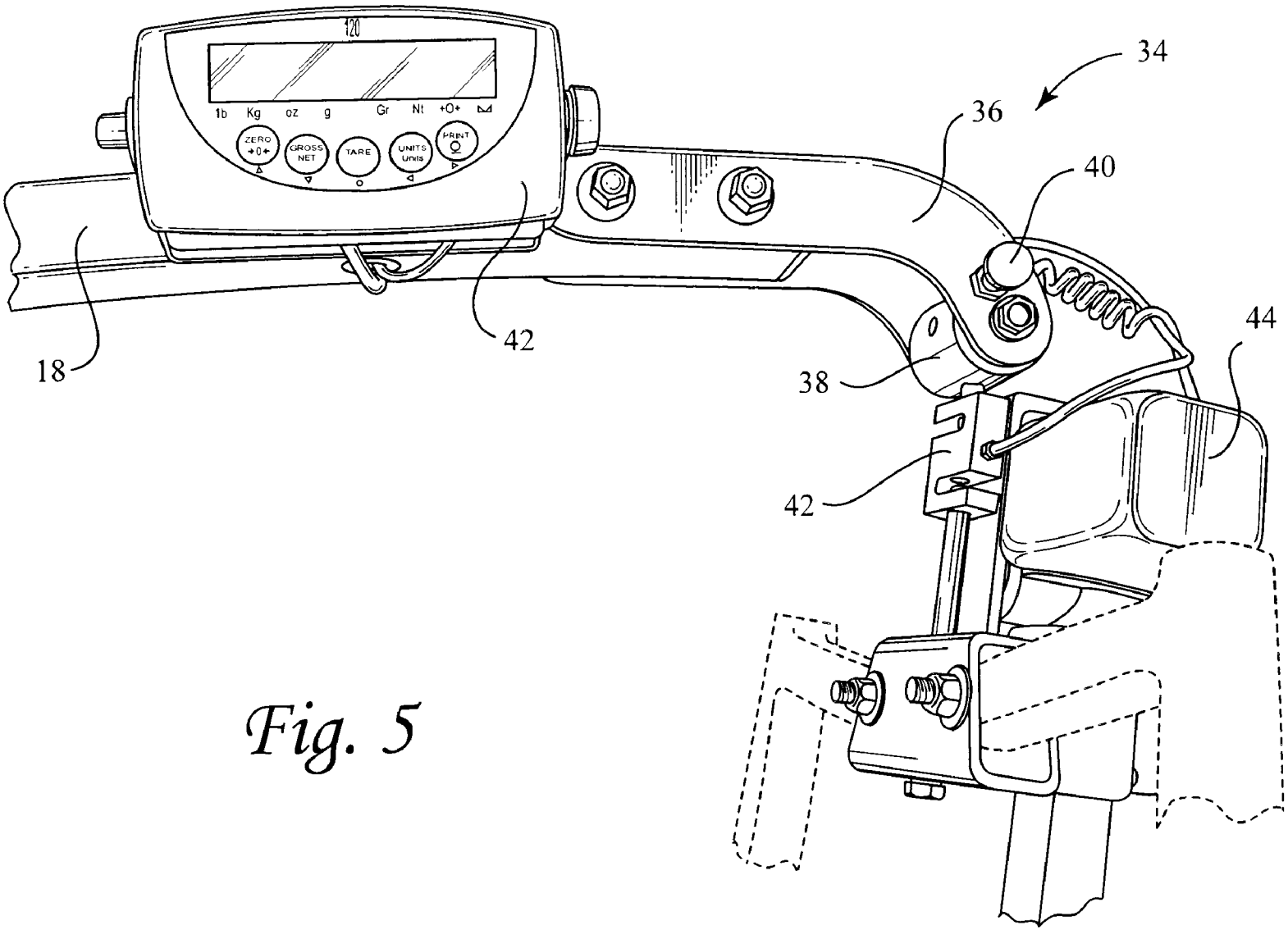
FIG. 5 is a perspective view of the extreme end of the second support member of the present invention.

Referring to FIG. 5, the extreme end of the second arm 18 of the device is shown. At the end of the second arm 18 a variety of devices are disposed for integrating a lifting mechanism. The end 34 of the second arm 18 comprises an end member 36. In alternate embodiments the second arm and end member may comprise a single piece. At the tip of the end member 36 a hinge mechanism 38 is disposed. The hinge mechanism 38 enables the payload of the device to swing freely. In one preferred embodiment, the hinge mechanism 38 is oriented about an axis so that only swinging movements parallel to the arms of the device are possible.

Still referring to FIG. 5, a locking mechanism 40 is associated with the hinge mechanism 38 to lock the mechanism in position if necessary. In another preferred embodiment, a scale 42 is provided for weighing the payload of the device. In yet another embodiment, a controller (not shown) operates a powered mechanical device 44 for operating a lifting means associated with the device.

The physical description of the device having been shown and described, a discussion of the functional aspects of the device follows:

In order to use the device of the present invention, a user begins by removing it from storage in its folded, compact configuration. In this configuration, the first and second arms are folded together and down to be adjacent to the floor supports. The articulating handle may be extended, and used to guide the device to a location to be unfolded. To unfold the device, the controller is operated to cause the first hydraulic cylinder to retract, thereby lifting the first arm toward a vertical position. Once sufficient clearance is achieved, the controller is operated to cause the second hydraulic cylinder to extend, thereby causing the second arm to unfold away from the first arm.

As the second arm unfolds, the support means and optionally the lifting device depends downward from the end of the second arm opposite the first arm. The support means is connected to the second member with a hinge that allows the support means to remain in a downward orientation. At any time, however, an engaging mechanism can be activated, causing the support means to lock into position relative to the second arm.

Once the device is unfolded, the lifting device can be attached to the support means if needed. In one preferred embodiment, the lifting device of U.S. Pat. No. 7,207,612 is attached. Once the lifting device is connected, the device is maneuvered so the floor supports extend under the bed, and the lifting mechanism is disposed above the subject to be moved. The controller is operated to cause the lifting device to open and lower over the subject. The controller is then used to cause the lifting device to lift the subject off the bed.

Once lifted, the first and second arms of the device can be articulated to move the subject up and down and toward or away from the base unit. Additionally, the hydraulics are calibrated so that a patient can be moved horizontally without changing vertical elevation in a manner similar to a level luffing crane. While the hydraulics cause the patient to be moved up and toward or away from the device, the device itself can be swiveled to move the position of the patient. By virtue of the swivel casters under the base unit and floor supports, and the rigid casters at the midpoint of the floor supports, the device can pulled in any direction or rotated on axis using the handle.

The connection between the hinge mechanism and lifting device permits the lifting device to spin on a vertical axis under the hinge mechanism, and also allows the lifting device to swing along the orientation of the first and second arms. This permits the lifting device to maintain a downward position as the first and second arms move. Once a subject is in a lifted position, to prevent the payload from swinging while the device is in motion, a locking mechanism in the support means locks the lifting mechanism in place. When the patient is completely supported by the lifting mechanism, weight measurements can be made using an on-board scale.

To lower a patient using the device, the locking mechanism is disengaged, and the first and second arms articulated to lower the lifting device to a surface. Once the subject comes to rest on the surface, the mechanical device disengages the lifting device from the subject. The first and second arms then lift the lifting device away from the subject.

Once a user is finished operating the device, the first and second arms can be refolded into a storable position, and the device moved to a storage location. Optionally, the device may be plugged in if necessary to re-charge the on-board battery.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A device for lifting and transporting invalids, comprising:

a. a base comprising a housing surrounding a power source and hydraulic actuators said base being supported on swiveling casters;

b. two parallel to each other support members extending from the base, the support members including end portions parallel to a supporting floor, wherein the base is higher than the support members, and the support members slant upward to connect to the base;

c. swivel casters located on the end portions of the support members and rigid casters located under the support members in a position between the swivel casters on the base and the swivel casters located on the end portions of the support members and support members to maneuver the device;

d. a first member with a proximal end extending from the base and a distal end;

e. a first hydraulic cylinder connected between the base and the first member;

f. a second member with a proximal end connected to the first member and a distal end;

g. a second hydraulic cylinder connected between the second member and the first member;

h. an invalid support means disposed at the distal end of the second member; and i. wherein the second member is capable of folding back upon the first member, and the first member is capable of folding to a position adjacent the support members for storage.

2. The device of claim 1, wherein a means for handling and steering the device is connected to the device, and wherein the handling means folds against the device when the device is in a storage position.

3. The device of claim 1, wherein the device comprises a scale that calculates the weight of a person or object supported by the support means.

4. The device of claim 1, wherein the first and second members are arched, so that when the device is in a storage position, a space is created for a hydraulic cylinder between the members.

5. The device of claim 1, wherein the support means is connected to the second member with a hinge mechanism further comprising a means of locking the support means in place to prevent persons or objects from swinging while supported by the device.

6. The device of claim 1, wherein the device comprises a lifter associated with the support means, wherein the lifter is an automatic pivot jawed lifting mechanism, the support means has means for opening and closing the jaws, and a controller associated with the device controls the lifter.

7. The device of claim 6, wherein the lifter can rotate relative to the support means.

8. The device of claim 1, wherein the device is rechargeable.

* * * * *